US008647013B2

(12) United States Patent
Davies et al.

(10) Patent No.: US 8,647,013 B2
(45) Date of Patent: Feb. 11, 2014

(54) REFLECTIVE SUBSTRATE SURFACE SYSTEM, REFLECTIVE ASSEMBLY, AND METHODS OF IMPROVING THE VISIBILITY OF A SUBSTRATE SURFACE

(75) Inventors: Chris Davies, Plymouth Meeting, PA (US); Kevin Goforth, Chester Springs, PA (US)

(73) Assignee: Potters Industries, LLC, Wilmington, DE (US)

( * ) Notice: Subject to any disclaimer, the term of this patent is extended or adjusted under 35 U.S.C. 154(b) by 286 days.

(21) Appl. No.: 13/020,904

(22) Filed: Feb. 4, 2011

(65) Prior Publication Data

US 2011/0195179 A1 Aug. 11, 2011

Related U.S. Application Data

(60) Provisional application No. 61/302,594, filed on Feb. 9, 2010.

(51) Int. Cl.
*B05D 5/06* (2006.01)
*E01C 23/16* (2006.01)

(52) U.S. Cl.
USPC ..... 404/75; 404/17; 404/94; 427/137

(58) Field of Classification Search
USPC ..... 404/17, 31, 72, 75, 94, 83.05, 111; 427/137
See application file for complete search history.

(56) References Cited

U.S. PATENT DOCUMENTS 2,326,634 A 8/1943 Gebhard
2,407,680 A 9/1946 Palmquist
2,440,584 A 4/1948 Heltzer
2,592,882 A 4/1952 Fisher
2,713,286 A 7/1955 Taylor
(Continued)

FOREIGN PATENT DOCUMENTS

EP 0102818 A2 3/1984
GB 558002 12/1943
(Continued)

OTHER PUBLICATIONS

Potters Industries Inc., Standard Highway, Safety Marking Spheres, Sep. 2004.

(Continued)

*Primary Examiner* — Raymond W Addie
(74) *Attorney, Agent, or Firm* — Buchanan Ingersoll & Rooney PC

(57) ABSTRACT

The present invention provides a marking system adapted for coating a surface of a substrate in which a drying agent is used. According to a first aspect of the invention, a binder layer, such as paint, is applied to the surface. A drying agent is dispensed into the spray of a binder and becomes incorporated with the binder on the substrate surface. The incorporation of the drying agent into the binder prior to application on the surface provides improved mixing of the drying agent and binder and improved performance. According to a second aspect of the invention, a combination of optical elements and a drying agent are stored in a common hopper and are dispensed into the spray of the binder and become incorporated with the binder on the substrate surface. The mixture of optical elements and drying agent prevents coagulation of the drying agent and the resulting clogging of the dispenser.

17 Claims, 2 Drawing Sheets

(56) References Cited

U.S. PATENT DOCUMENTS

| | | | | |
|---|---|---|---|---|
| 3,099,637 | A | 7/1963 | Nellessen | |
| 3,413,058 | A | 11/1968 | Fang | |
| 3,758,192 | A | 9/1973 | Bingham | |
| 3,762,825 | A | 10/1973 | Reusser | |
| 3,764,455 | A | 10/1973 | Lovell | |
| 3,801,183 | A | 4/1974 | Sevelin | |
| 3,877,787 | A | 4/1975 | Buzbee | |
| 3,915,771 | A | 10/1975 | Gatzke | |
| 3,971,692 | A | 7/1976 | Anderson | |
| 4,031,048 | A | 6/1977 | Holmen | |
| 4,040,760 | A | 8/1977 | Wyckoff | |
| 4,055,377 | A | 10/1977 | Erickson | |
| 4,069,787 | A | 1/1978 | Wyckoff | |
| 4,105,808 | A | 8/1978 | McKenzie | |
| 4,117,192 | A | 9/1978 | Jorgensen | |
| 4,218,439 | A | 8/1980 | Rivier | |
| 4,265,937 | A | 5/1981 | Kameya | |
| 4,609,587 | A | 9/1986 | Giordano | |
| 4,648,689 | A | 3/1987 | May | |
| 4,681,401 | A | 7/1987 | Wyckoff | |
| 4,721,649 | A | 1/1988 | Belisle et al. | |
| 4,758,469 | A | 7/1988 | Lange | |
| 4,856,931 | A | 8/1989 | Bollag | |
| 5,049,001 | A | 9/1991 | Dinitz | |
| 5,286,682 | A | 2/1994 | Jacobs et al. | |
| 5,620,775 | A | 4/1997 | LaPerre | |
| 5,650,213 | A | 7/1997 | Rizika | |
| 5,679,437 | A | 10/1997 | Hackworth | |
| 5,718,534 | A * | 2/1998 | Neuling | 404/94 |
| 5,750,191 | A | 5/1998 | Hachey | |
| 5,784,198 | A | 7/1998 | Nagaoka | |
| 5,820,988 | A | 10/1998 | Nagaoka | |
| 5,835,271 | A | 11/1998 | Stump | |
| 5,873,187 | A | 2/1999 | Kozak | |
| 5,882,771 | A | 3/1999 | Klein et al. | |
| 5,917,652 | A | 6/1999 | Mathers | |
| 5,941,655 | A | 8/1999 | Jacobs | |
| 5,942,280 | A | 8/1999 | Mathers | |
| 5,947,632 | A | 9/1999 | Pirotta et al. | |
| 5,988,822 | A | 11/1999 | Abe et al. | |
| 6,127,020 | A | 10/2000 | Bacon, Jr. et al. | |
| 6,247,818 | B1 | 6/2001 | Hedblom | |
| 6,326,053 | B1 | 12/2001 | Stump | |
| 6,479,132 | B2 | 11/2002 | Hedblom | |
| 6,514,595 | B1 | 2/2003 | Sprouts | |
| 6,521,718 | B2 | 2/2003 | Goeb et al. | |
| 6,623,793 | B2 | 9/2003 | Mushett | |
| 6,624,937 | B2 | 9/2003 | Kashima | |
| 6,645,552 | B1 | 11/2003 | Schall et al. | |
| 6,696,126 | B1 | 2/2004 | Fischer | |
| 6,703,108 | B1 | 3/2004 | Bacon, Jr. | |
| 6,734,227 | B2 | 5/2004 | Jing | |
| 6,796,740 | B2 | 9/2004 | Chiron et al. | |
| 6,815,040 | B2 | 11/2004 | Pellerite | |
| 6,884,510 | B2 | 4/2005 | Qui | |
| 6,905,754 | B2 | 6/2005 | Jing | |
| 6,916,103 | B2 | 7/2005 | Currie et al. | |
| 7,128,799 | B2 | 10/2006 | Majumdar | |
| 7,303,292 | B2 | 12/2007 | Yukawa | |
| 2002/0090505 | A1 | 7/2002 | Stoffers et al. | |
| 2003/0012599 | A1 | 1/2003 | Wallgren | |
| 2003/0090800 | A1 | 5/2003 | Humpal | |
| 2003/0123930 | A1 | 7/2003 | Jacobs | |
| 2005/0001342 | A1 | 1/2005 | Durant | |
| 2005/0137266 | A1 | 6/2005 | Jing | |
| 2006/0062965 | A1 | 3/2006 | Durant et al. | |
| 2006/0165961 | A1 | 7/2006 | Tsutsui | |
| 2006/0256439 | A1 | 11/2006 | Yukawa | |
| 2006/0293161 | A1 | 12/2006 | Frey | |
| 2007/0110960 | A1 | 5/2007 | Frey | |
| 2008/0030856 | A1 | 2/2008 | King | |
| 2008/0253833 | A1 | 10/2008 | Gelfant et al. | |
| 2010/0127100 | A1 * | 5/2010 | Walmer | 239/304 |
| 2012/0121333 | A1 * | 5/2012 | Schroeder et al. | 404/93 |

FOREIGN PATENT DOCUMENTS

| | | |
|---|---|---|
| GB | 559261 | 2/1944 |
| GB | 586594 | 3/1947 |
| GB | 598330 | 2/1948 |
| GB | 641547 | 8/1950 |
| GB | 867783 | 5/1961 |
| GB | 877083 | 9/1961 |
| GB | 903948 | 8/1962 |
| GB | 940424 | 10/1963 |
| GB | 952258 | 3/1964 |
| GB | 972442 | 10/1964 |
| GB | 985515 | 3/1965 |
| GB | 1000184 | 8/1965 |
| GB | 1037265 | 7/1966 |
| GB | 1087031 | 10/1967 |
| GB | 1201548 | 8/1970 |
| GB | 1209450 | 10/1970 |
| GB | 1447585 | 8/1976 |
| JP | 2000-171624 | 6/2000 |
| JP | 2005-104768 | 4/2005 |
| WO | WO/2004/110733 | 12/2004 |
| WO | WO/2008/039912 | 4/2008 |

OTHER PUBLICATIONS

Potters Industries Inc., Premium Highway; Safety Marking Spheres, Sep. 2004.

Potters Industries Inc., Visibead Plus II, Highway Safety Marking Spheres, Sep. 20, 2004.

Diamond Vogel Paint, TB-Series High Quality Alkyd Zone Marking Paint; TB-Series.doc revised Apr. 2007.

Diamond Vogel Paint, UC-Series Waterborne Traffic Marking Paint, UC-Series.doc revised May 2007.

* cited by examiner

REFLECTIVE SUBSTRATE SURFACE SYSTEM, REFLECTIVE ASSEMBLY, AND METHODS OF IMPROVING THE VISIBILITY OF A SUBSTRATE SURFACE

CROSS-REFERENCE TO RELATED APPLICATIONS

This application claims priority to U.S. provisional patent application No. 61/302,594, filed on Feb. 9, 2010, and incorporated by reference herein.

FIELD OF THE INVENTION

This invention relates to a system for use in improving the visibility of a surface, such as reflective substrate surface elements and other reflective articles, and more particularly to a system in which the optical elements for the reflective article are stored and dispensed in combination with a binder drying agent.

BACKGROUND OF THE INVENTION

Reflective elements are incorporated in traffic signs, pavement markings and apparel. Pavement markings, for example such as those on the centerline and edge of a roadway, provide visual guidance for motor vehicle drivers. The visibility provided by these pavement markings is particularly vital for night time navigation and for navigation during inclement weather conditions.

U.S. Pat. No. 6,127,020 to Bacon, Jr. et al. teaches that such pavement markings typically include glass microspheres that are partially embedded in a binder layer containing reflective pigment particles such as titanium dioxide ($TiO_2$) or lead chromate ($PbCrO_4$). As light from the headlamp of a vehicle impinges upon the microsphere, it is refracted towards the reflective pigment. Refraction as used herein refers to the deflection of light from its original pathway. The light passes through the optical element and is scattered by the pigment-containing pavement paint. A portion of the scattered light is directed back through the optical element and is directed back along the original path towards the driver, increasing the visibility of the markings. This results in a retroreflective effect wherein the most intense light travels back along the illumination axis, which is the centerline between the headlamp and the microsphere, and the light becomes dimmer the farther it is viewed from the illumination axis. Retroreflection as used herein refers to the tendency of light to travel back along its original pathway upon hitting certain surfaces.

The intensity of the light returning to the driver depends upon, among other things, the effective refractive index of the pavement marking. Refractive index as used herein refers to the magnitude by which the speed of light is reduced within a medium. The microspheres have an inherent refractive index; however, U.S. Pat. No. 6,796,740 to Chiron et al. explains that a lower effective refractive index will result if a film of water from recent rainfall has covered the pavement marking. The angle of incidence with which the light impinges upon the microsphere also bears upon the intensity of the light reaching the driver's eyes. Furthermore, retroreflectivity may diminish as traffic erodes the pavement marking surface, if the traffic causes the microspheres to become dislodged from the binder.

In order to maintain retroreflectivity, it has been suggested to use a reflective marking system wherein a first layer of binder is applied to the surface of the substrate, and a first layer of optical elements is partially embedded in the top surface of the first layer of binder. A second layer of binder is applied to cover the first layer of optical elements such that the first layer of optical elements defines a plurality of undulations in the second layer of binder and a second layer of optical elements is partially embedded in the top surface of the second layer of binder and has an exposed-lens surface portion. As the top layer of optical elements and binder is eroded, the underlying layer optical elements will be exposed, thereby maintaining retroreflectivity. Such a system is described in U.S. patent application Ser. No. 12/428,117, filed Apr. 22, 2009, which is incorporated by reference herein in its entirety.

In order to enhance the application of the pavement marking, drying agents are applied to the binder. These drying agents allow the pavement to be marked during damp conditions and also speed up the application process, thereby minimizing the restriction to full utilization of the roadway. The typical application of paint, drying agent and beads is as follows:

1. Paint is applied to the pavement surface;
2. Paint drying accelerant is applied on top of the paint;
3. Anti-skid glass grains are applied on top of the paint; and
4. Retroreflective glass beads are applied and embedded in the paint.

In use, it is often difficult to adequately intermix the drying agent with the binder in order to achieve optimum results. In addition, the drying agent generally is formulated as beads which have a tendency to coagulate and block the dispensing mechanism. This clogging requires periodic cleaning and causes unscheduled delays in the pavement marking. The clogging also prohibits the accurate metering of the dispensed drying agent.

It is highly desirable to provide a reflective marking system which provides a high degree of retroreflectivity, allows for improved intermixing of the drying agent and binder, and also minimizes the clogging of the drying agent dispenser.

SUMMARY OF THE INVENTION

The present invention provides a marking system adapted for coating a surface of a substrate in which a drying agent is used. According to a first aspect of the invention, a drying agent and the optical elements to be applied to the surface are stored in a common hopper and dispensed together in an intermixed composition. In operation, a binder layer, such as paint, is applied to the surface. The intermixed drying agent and optical elements are dispensed together into the spray of the binder and become incorporated with the binder on the substrate surface. The combination of the drying agent and the optical elements prevents the drying agent from agglomerating and provide a clean and unhindered dispensing of the drying agent.

In a second aspect of the invention, a binder layer, such as paint, is applied to the surface. A combination of optical elements and a drying agent which are stored in a common hopper are dispensed into the spray of the binder and become incorporated with the binder on the substrate surface. The mixture of optical elements and drying agent prevents coagulation of the drying agent and the resulting clogging of the dispenser. If desired, additional optical elements or other components may be subsequently applied to the binder/drying agent/optical element layer.

The combination of the drying agent and optical elements can also be used with a hand walker striping apparatus. In such an application, binder is first applied to the surface and the blend of the intermixed drying agent and optical elements is dropped onto the binder. A second layer of binder is then applied and a layer of optical elements are then dropped onto the second binder layer.

It is to be understood that both the foregoing general description and the following detailed description are exemplary, but are not restrictive, of the invention.

BRIEF DESCRIPTION OF THE DRAWING

The accompanying drawings incorporated in and forming a part of the specification illustrate several aspects of the present invention and, together with the description, serve to explain the principles of the invention. In the drawing.

Figure 1:
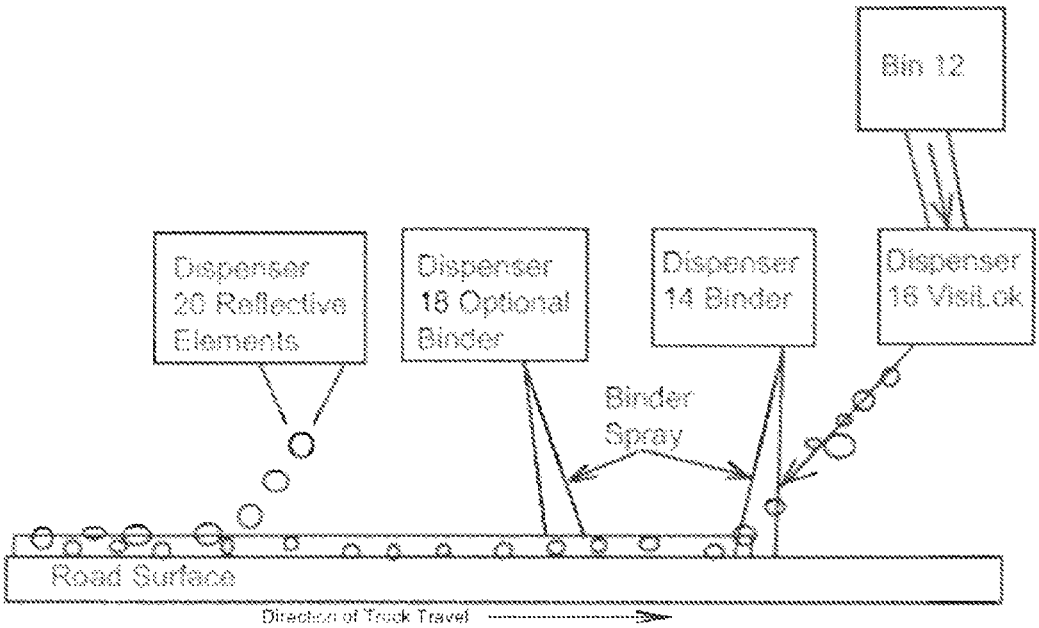
FIG. 1 is a schematic representation of a dispensing system in accordance with the present invention.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

The present invention is directed to reflective surface marking systems and reflective elements and methods of applying the reflective marking system to a substrate such as roadway pavement by means of a truck-mounted line striping apparatus or a hand walking striping apparatus. Reflective marking systems according to the present invention include a first layer of binder, optical elements, such as glass beads, which are embedded in the binder, an optional second layer of binder and an optional second layer of optical elements embedded in the second layer of binder. Methods of applying a reflective marking to a substrate according to the present invention include applying a first layer of binder, dispensing a mixture of optical elements and drying agent into the binder stream for application onto the substrate, optionally applying a second layer of binder onto the first layer of optical elements and optionally applying a second layer of optical elements onto the second layer of binder.

In order to enhance drying times of the binder, especially in wet conditions, a drying agent or accelerator, preferably DOW Fastrack QS-2, is applied to the binder. The drying agent improves the ability of the binder to dry even in wet conditions and will speed up the surface marking process in both wet and dry conditions. Other suitable drying agents include silica gel.

It has been found that the performance of the drying agent is enhanced if it is incorporated into the binder prior to application on the roadway surface. To accomplish this, the drying agent is dispensed directly into the spray of the binder. The binder and drying agent are stored in separate bins, and the dispenser gun for the drying agent orients its spray directly into the spray path of the binder, allowing the binder and drying agent to mix prior to the binder being applied to the surface. Such a dispensing system is well suited for use in connection with a truck-mounted line striping apparatus.

The most common drying agent is a spherical plastic bead designed to absorb water. Because of its absorption properties, the drying agent tends to coagulate into clumps which hinder the ability to dispense a consistent and even stream of the beads into the binder and prohibits the accurate metering of the dispensed drying agent.

It has been found that the intermixture of the optical elements and the drying agent allow for a clean and unhindered dispensation of the drying agent onto the substrate. A presently preferred ratio of intermix glass beads to drying agent is 2:1 by weight. This ratio can be adjusted depending on the thickness of the binder layer which typical is within the range of 7 to 60 mils (0.2 to 1.5 mm).

Suitable intermix glass beads have been found to be Potters Safety Marking Spheres of M247 Type 1 size coated with a dual coating. A suitable drying agent includes VISILOK® traffic pavement dryer provided by Potters Industries which has been found to accelerate the drying time of the binder, approximately halving the cure time, in order to assure extended high performance of the marking system. Suitable optical elements include Potters VISIMAX® safety marking spheres, Potters FLEX-O-LITE Type III 1.9 RI glass beads, and Potters VISIBEAD and Safety Marking Spheres glass beads. Glass beads of other sizes can be utilized. The size ranges of the various optical elements are outlined in Table I below:

TABLE I

| Optical Element | Size Range (US Mesh) | Size Range (μm) |
|---|---|---|
| VISIMAX ® | 12 to 20 nominal | 841-1680 |
| FLEX-O-LITE Type III 1.9 RI | 18 to 50 nominal | 297-1000 |
| VISIBEAD | 12 to 25 nominal | 707-1680 |
| Safety Marking Spheres | 20 to 80 nominal | 177-841 |

In order to prevent clumping of the drying agent, the optical elements and drying agent are stored together in the same bin. It has been found that this intermixing of the drying agent and optical elements prevents the drying agent from coagulating into large clumps. It has been found that the drying agent beads will form a thin layer around the optical element spheres, thereby allowing easy passage of the drying agent and optical element through the dispenser.

The binder material can be a water-borne paint such as Ennis High Build Waterborne or Vogel UC 3588. The binder material and drying agent/optical element mixture can be applied to a substrate such as a roadway using a GRACO LineLazer IV 200HS retrofitted by A-1 Road Lines.

In a presently preferred method, the dispenser for the drying agent/optical element mixture will direct the mixture directly into the binder dispensing steam. FIG. 1 is a schematic representation of a preferred dispensing system 10. As shown in FIG. 1, the mixture of drying agent and optical elements is stored in bin 12. Dispenser 14 applies the binder to the roadway. Dispenser 16 applies the mixture of drying agent and optical elements and is oriented such that dispenser 16 dispenses the stream of the drying agent and optical element mixture directly into the stream of binder from dispenser 14. If desired, additional dispensers 18 and 20 for applying optional additional layers of binder and reflective elements, respectively, can be utilized. Dispensers 18 and 20 are adapted to apply the option layers of binder and reflective elements after dispenser 12 and dispenser 14 have applied the binder, drying agent and optical elements.

In an alternative embodiment, the optical elements can be dispensed separately from the drying agent. In this embodiment, bin 12 would contain only the drying agent. A separate bin and dispenser of standard configuration (not shown) would separately apply the optical elements onto the binder/drying agent layer already applied to the roadway.

EXAMPLES

Several experiments were conducted to test the dispensing system of the present invention.

Example 1

The dispensing system in accordance with the present invention was used to apply a retroreflective striping on to grooves of a four-lane federal highway which experiences heavy traffic with cars, trucks and farm equipment. A summary of the material and application specifications is set forth in Table II below:

TABLE II

| MATERIALS | |
|---|---|
| BEADS: | VisiLok and VisiPlus 2 and Visimax |
| BINDER: | Vogel UC 3588 |
| BINDER GUNS: | Graco |
| BEAD GUN: | EZ Liner |
| DROP RATE: | 6 lbs/100 sq ft (29 kg/m$^2$) |
| WET MIL THICKNESS: | 30 wet mils (unmeasured) (760 μm). |
| MARKING WIDTH: | 4-Inch (10 cm) Test Markings/Lines. |
| APPLICATION SPEED: | 5-5.5 mph. (8-9 km/hr) |
| ROAD SURFACE: | Concrete and Asphalt |

The installation was uneventful. There was rain the day before and the day after application. Grooves were cut into the concrete and asphalt on the inside of the existing pavement markings. Retroreflectivity measurements were taken on two of the sections of the striped highway. Table III below sets forth the retroreflectivity measurements.

TABLE III

| MARKING | SECTION | RETROREFLECTIVITY |
|---|---|---|
| VisiLok with VisiPlus 2 and Ultra 1.9 | 4 - Westbound | Yellow Edge Line = 369<br>White Skip = 725 |
| VisiMax | 15 - Westbound | Yellow Edge Line = 577<br>White Skip = 613 |

It is expected that the retroreflectivity of the Section 4 striping will increase as the paint continues to cure.

Example 2

The dispensing system of the present invention was utilized on a four-lane federal highway which experiences heavy vehicular traffic in the form of cars, trucks, and farm equipment. Installation took place during a very damp day. A summary of the material application specifications is set forth below in Table IV:

TABLE IV

| MATERIALS | | |
|---|---|---|
| | Drop On Beads | Intermix Bead |
| Bead Type | VisiPlus 2 and Ultra 1.9 | VisiLok |
| Binder | Ennis High Build Waterborne | |
| Binder Guns | Graco | Speedbeader |
| Bead Gun | Speedbeader | |
| Drop Rate | 10/10 lbs/100 sq ft (10/48 kg/m$^2$) | 54 lbs/mile (15 kg/km) |

TABLE IV-continued

| MATERIALS | | |
|---|---|---|
| | Drop On Beads | Intermix Bead |
| Wet Mil Thickness | 25 wet mils (600 μm) | |
| Marking Width | 6 inch (15 cm) | |
| Application Speed | 6 mph (10 km/hr) | |
| Road Surface | Concrete | Surface Applied |

Initial retroreflectivity measurements were taken the day of installation. Two month retroreflectivity measurements were also taken using MX30. During the application of the striping to Section 7, a car ran over the line when the line was wet. The retroreflectivity measurement taken after two months was measured on a non-tracked location in that section. Table V below sets for the retroreflectivity measurements:

TABLE V

| Section | Wet Mils | Intermix Bead | Drop On Glass Bead | Initial Retro. | Retro. after 2 months |
|---|---|---|---|---|---|
| 1 | 25 | None | IA Type 3 | 518 | 495 |
| 2 | 25 | VisiLok Type 1 | IA Type 3 | 538 | 531 |
| 3 | 25 | VisiLok Type 1 | IA Type 3/ Ultra 1.9 Blend | 601 | 562 |
| 4 | 25 | None | IA Type 3/ Ultra 1.9 Blend | 470 | 454 |
| 5 | 32 | None | IA Type 3 | 495 | 462 |
| 6 | 32 | VisiLok Type 1 | IA Type 3 | 398 | 438 |
| 7 | 32 | VisiLok Type 1 | IA Type 3/ Ultra 1.9 Blend | 143 | 413 |
| 8 | 32 | None | IA Type 3/ Ultra 1.9 Blend | 436 | 349 |
| 9 | 32 | VisiLok Type 4 | VisiPlus 2/ Ultra 1.9 Blend | 484 | 397 |
| 10 | 32 | None | VisiPlus 2/ Ultra 1.9 Blend | 484 | 374 |
| 11 | 32 | VisiLok Type 4 | IA Type 3 | 229 | 375 |

Example 3

The dispensing system of the present invention was used to apply striping to a four lane highway that experiences heavy car and truck traffic. Striping was performed on to both asphalt and concrete decks and grooves were cut into the concrete and asphalt. A summary of the material and application specifications is set forth in Table VI below:

TABLE VI

| MATERIALS | | |
|---|---|---|
| Beads | VisiPlus 2 and Ultra 1.9 | VisiLok |
| Binder | Ennis High Build Waterborne | |
| Binder Guns | Graco | Speedbeader |
| Bead Gun | MRL | |
| Drop Rate | 12/10 lbs/100 sq ft (10/48 kg/m$^2$) | 54 lbs/mile (15 kg/km) |
| Wet Mil Thickness | 26 wet mils | |
| Marking Width | 4 inch (10 cm) | |
| Application Speed | 4 mph (6.4 km/hr) | |
| Road Surface | Asphalt and Concrete | Grooved 80 mils deep |

Retroreflectivity measurements were taken one month after application of the striping. Table VII below sets forth the retroreflectivity measurements:

TABLE VII

| Section | Road | Marking | Retroreflectivity |
|---|---|---|---|
| 1 | Asphalt | White VisiLok | 584 |
| | | Yellow | 437 |
| 2 | Concrete | White VisiLok | 712 |
| | | Yellow | 526 |

As the above examples demonstrate, the dispensing system of the present invention provides striping on a roadway payment with superior retroreflectivity and performance. Because of the intermixture of the drying agent and optical element, no clogging of the dispenser occurred.

Figure 2:
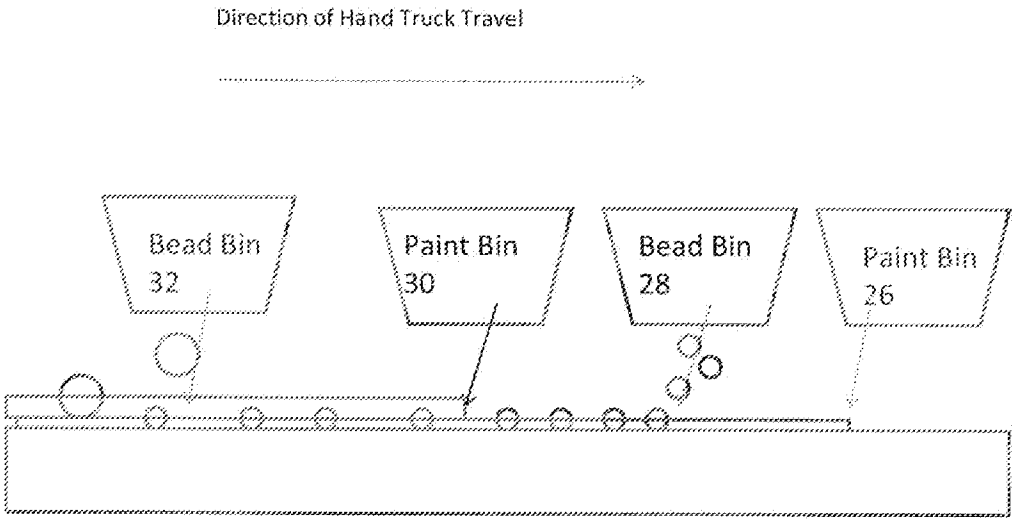
FIG. 2 is a schematic representation of a hand walking dispensing system in accordance with the present invention.

In an alternative arrangement shown in FIG. 2, the intermixed drying agent and optical elements can be applied to the surface of a substrate 24 by means of a hand walking striping apparatus. In such an arrangement, paint spray gun 26 applies a first layer of binder upon which dispenser 28 applies the intermixed drying agent and optical elements. An optional second binder layer can be administered by paint spray gun 30 and an optional layer of drop on reflective elements can be applied by dispenser 32.

The present invention allows for the metered dispensing of drying agent to provide a more precise control of the curing of the binder. In the long term, the intermixed optical elements provide retroreflectivity for an extended time period which eliminates the need to stripe the roadway as frequently as would otherwise be necessary.

The method can be carried out using any suitable commercially available application system. A single vehicle is preferably used to carry out all four steps, but any combination of up to four vehicles can be used.

Although the invention is illustrated and described herein with reference to specific embodiments, the invention is not intended to be limited to the details shown. Rather, various modifications may be made in the details within the scope and range of equivalents of the claims and without departing from the invention.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein.

All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. Use of the term "about" should be construed as providing support for embodiments directed to the exact listed amount. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A method for coating a transportation corridor surface of a substrate to improve the visibility of the surface comprising the steps of:

a) providing a mixture of a paint drying agent and an optical element, said drying agent being at least an absorbent hollow polymeric plastic bead;

b) applying a layer of paint to a roadway; and c) applying said mixture of a paint drying agent and an optical element to said roadway, wherein said hollow polymeric plastic bead is collapsed by the weight of vehicles passing over it;

whereby the application of said mixture of said paint drying agent and said optical element provides proper metering of said paint drying agent.

2. The method of claim 1 further comprising the steps of:

d) applying a second layer of paint to said roadway marking; and e) applying a layer of optical elements onto said second layer of paint.

3. The method of claim 2 wherein a spray of said mixture is directed into a spray of said paint and incorporated therein prior to application onto said roadway.

4. The method of claim 1 wherein a spray of said mixture is directed into a spray of said paint and incorporated therein prior to application onto said roadway.

5. A method for coating a transportation corridor surface of a substrate to improve the visibility of the surface comprising the steps of:

a) providing a mixture of a paint drying agent and an optical element, said drying agent being at least a silica gel;

b) applying a layer of paint to a roadway; and c) applying said mixture of a paint drying agent and an optical element to said roadway, wherein said silica gel does not discolor the paint;

whereby the application of said mixture of said paint drying agent and said optical element provides proper metering of said paint drying agent.

6. The method of claim 5 further comprising the steps of:

d) applying a second layer of paint to said roadway marking; and e) applying a layer of optical elements onto said second layer of paint.

7. The method of claim 6 wherein a spray of said mixture is directed into a spray of said paint and incorporated therein prior to application onto said roadway.

8. The method of claim 5 wherein a spray of said mixture is directed into a spray of said paint and incorporated therein prior to application onto said roadway.

9. A method of dispensing transportation corridor surface markings using a machine having a first dispenser for applying a layer of paint to a roadway; and a second dispenser for applying a mixture of a paint drying agent and an optical element, said drying agent being at least one of an absorbent hollow polymeric plastic bead and a silica gel, the method comprising a) providing a mixture of said paint drying agent and said optical element;

b) applying a layer of paint to a roadway; and c) applying said mixture of a paint drying agent and an optical element to said roadway;

whereby the application of the mixture of said paint agent and said optical element provides proper metering of the drying agent.

10. The method of claim 9, wherein said machine has a third dispenser for applying a second layer of paint to said roadway marking; and a fourth dispenser for applying a layer of optical elements onto said second layer of paint.

11. The method of claim 10, wherein said second dispenser is oriented such that the spray of said mixture is directed into the spray of said paint.

12. The method of claim 10 wherein the system is used on a truck-mounted line striping apparatus.

13. The method of claim 10 wherein the system is used on a hand walking apparatus.

14. The method of claim 9, wherein said second dispenser is oriented such that the spray of said mixture is directed into the spray of said paint.

15. A transportation corridor surface marking dispensing system comprising:

a) a first dispenser for applying a layer of paint to a roadway; and b) a second dispenser for applying a paint drying agent and an optical element, said drying agent being at least one of an absorbent hollow polymeric plastic bead and a silica gel, wherein said second dispenser is oriented such that the spray of said drying agent is directed into the spray of said paint, whereby the mixture of said drying agent and said optical element in the second dispenser provides proper metering of the drying agent.

16. The marking system of claim 15, further comprising:

c) a third dispenser for applying a layer of optical elements to said roadway marking.

17. The marking system of claim 16, further comprising:

d) a fourth dispenser for applying a second layer of paint to said roadway marking; and e) a fifth dispenser for applying a layer of optical elements onto said second layer of paint.

* * * * *